US010177488B2

(12) United States Patent
Zhao

(10) Patent No.: US 10,177,488 B2
(45) Date of Patent: Jan. 8, 2019

(54) ELECTRICAL CONNECTOR HAVING A FIRMLY SECURED FRONT SEALING MEMBER

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/842,913

(22) Filed: Dec. 15, 2017

(65) Prior Publication Data

US 2018/0175543 A1 Jun. 21, 2018

(30) Foreign Application Priority Data

Dec. 15, 2016 (CN) ..... 2016 1 1157357

(51) Int. Cl.
*H01R 24/60* (2011.01)
*H01R 13/6581* (2011.01)
(Continued)

(52) U.S. Cl.
CPC ..... *H01R 13/5219* (2013.01); *H01R 13/6581* (2013.01); *H01R 24/20* (2013.01); *H01R 2107/00* (2013.01)

(58) Field of Classification Search
CPC ..... H01R 24/60; H01R 13/5219; H01R 13/5202; H01R 13/6581; H01R 13/6585;
(Continued)

(56) References Cited

U.S. PATENT DOCUMENTS 8,491,323 B2 * 7/2013 Ishibashi ..... H01R 13/5221 439/205
8,562,377 B2 * 10/2013 Kawamura ..... H01R 9/032 439/607.44

(Continued)

FOREIGN PATENT DOCUMENTS

CN 205016762 2/2016
CN 205944583 2/2017

*Primary Examiner* — James Harvey
*Assistant Examiner* — Matthew T Dzierzynski
(74) *Attorney, Agent, or Firm* — Wei Te Chung; Ming Chieh Chang

(57) ABSTRACT

An electrical connector includes: an insulative housing having a base portion and a tongue portion; plural contacts affixed to the insulative housing and exposed to the tongue portion; a shielding shell enclosing the insulative housing and having a front end; an outer cover enclosing the shielding shell and having a front protrusion, the front protrusion having a pair of side slots; and a sealer having a main body and a pair of side securing portions; wherein an annular groove is defined between the front end of the shielding shell and the front protrusion of the outer cover, the front protrusion of the outer cover having a first inclined face bordering the groove; and the sealer main body is disposed in the groove and the side securing portions engage the side slots, the sealer main body having a second inclined face opposing the first inclined face.

16 Claims, 16 Drawing Sheets

(51) Int. Cl.

| | |
|---|---|
| ***H01R 13/52*** | (2006.01) |
| ***H01R 24/20*** | (2011.01) |
| *H01R 107/00* | (2006.01) |

(58) Field of Classification Search
CPC .. H01R 43/005; H01R 12/724; H01R 13/516; H01R 13/521; H01R 43/20; H01R 13/5205; H01R 13/5216; H01R 13/5221; H01R 13/533
See application file for complete search history.

(56) References Cited

U.S. PATENT DOCUMENTS

| | | | | |
|---|---|---|---|---|
| 8,827,742 | B2 * | 9/2014 | Wang | H01R 24/68 439/569 |
| 9,136,616 | B2 * | 9/2015 | Zhao | H01R 12/724 |
| 9,379,478 | B2 * | 6/2016 | Fabre | H01R 13/506 |
| 9,379,481 | B2 * | 6/2016 | Kashiwada | H01R 13/5213 |
| 9,379,509 | B2 * | 6/2016 | Guo | H01R 13/633 |
| 9,385,484 | B2 * | 7/2016 | Chen | H01R 13/6594 |
| 9,429,360 | B2 * | 8/2016 | Hsiao | F26B 3/28 |
| 9,444,177 | B2 * | 9/2016 | Tsai | H01R 13/5202 |
| 9,570,839 | B2 * | 2/2017 | Hashimoto | H01R 13/5202 |
| 9,620,899 | B2 * | 4/2017 | Kato | H01R 13/631 |
| 9,793,644 | B2 * | 10/2017 | Fujii | H01R 13/6581 |
| 9,819,120 | B2 * | 11/2017 | Mukuno | H01R 13/533 |
| 9,825,398 | B1 * | 11/2017 | Uchida | H01R 13/5219 |
| 9,843,128 | B2 * | 12/2017 | Tsai | H01R 13/5202 |
| 9,887,485 | B2 * | 2/2018 | Lambie | H01R 13/5219 |
| 9,929,491 | B2 * | 3/2018 | Yamaguchi | H01R 11/12 |
| 9,991,625 | B2 * | 6/2018 | Ozaki | H01R 13/5219 |
| 10,027,052 | B2 * | 7/2018 | Yudate | H01R 13/5202 |
| 2016/0036158 | A1 * | 2/2016 | Adachi | H01R 13/5202 439/587 |
| 2016/0043500 | A1 * | 2/2016 | Mori | H01R 13/504 439/271 |
| 2017/0250495 | A1 * | 8/2017 | Yudate | H01R 13/5202 |
| 2018/0034172 | A1 * | 2/2018 | Singhammer | H01R 43/20 |
| 2018/0175537 | A1 * | 6/2018 | Kashiwada | H01R 13/44 |

* cited by examiner

ELECTRICAL CONNECTOR HAVING A FIRMLY SECURED FRONT SEALING MEMBER

BACKGROUND OF THE INVENTION

1. Field of the Invention

The present invention relates to an electrical connector including a front sealing member securely disposed in a groove defined between a shielding shell and an outer cover thereof.

2. Description of Related Arts

China Patent No. 205016762 discloses an electrical connector including an insulative housing, a plurality of conductive terminals secured to the insulative housing, a metal shell enclosing the insulative housing, an outer cover enclosing the metal shell and having a peripheral recess, and a sealing member or sealer attached to the recess with the aid of an adhesive. However, the adhesive may lose its property after repeated use and affect the waterproof function of the sealer.

An electrical connector having a sealer firmly secured in place is desired.

SUMMARY OF THE INVENTION

An electrical connector comprises: an insulative housing having a base portion and a tongue portion; a plurality of contacts affixed to the insulative housing and exposed to the tongue portion; a shielding shell enclosing the insulative housing and having a front end; an outer cover enclosing the shielding shell and having a front protrusion, the front protrusion having a pair of side slots; and a sealer having a main body and a pair of side securing portions; wherein an annular groove is defined between the front end of the shielding shell and the front protrusion of the outer cover, the front protrusion of the outer cover having a first inclined face bordering the groove; and the sealer main body is disposed in the groove and the side securing portions engage the side slots, the sealer main body having a second inclined face opposing the first inclined face.

BRIEF DESCRIPTION OF THE DRAWING

FIG. 15 (A) is an enlarged view of the circled are in FIG. 14 without showing the front sealer.

DETAILED DESCRIPTION OF THE PREFERRED EMBODIMENT

Figure 1:
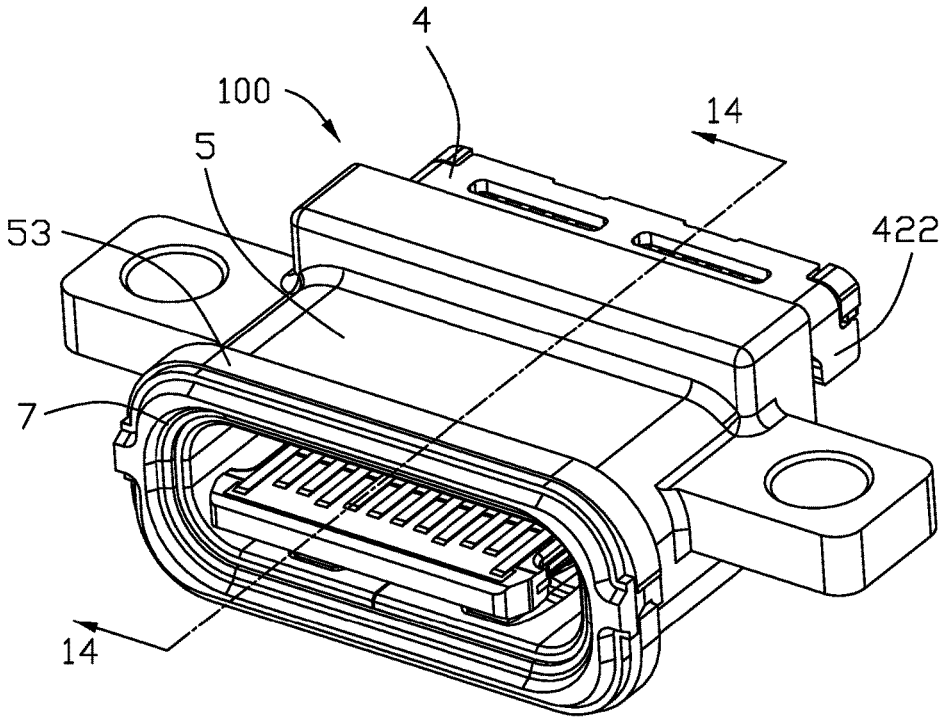
FIG. 1 is a perspective view of an electrical connector in accordance with the present invention.
Figure 2:
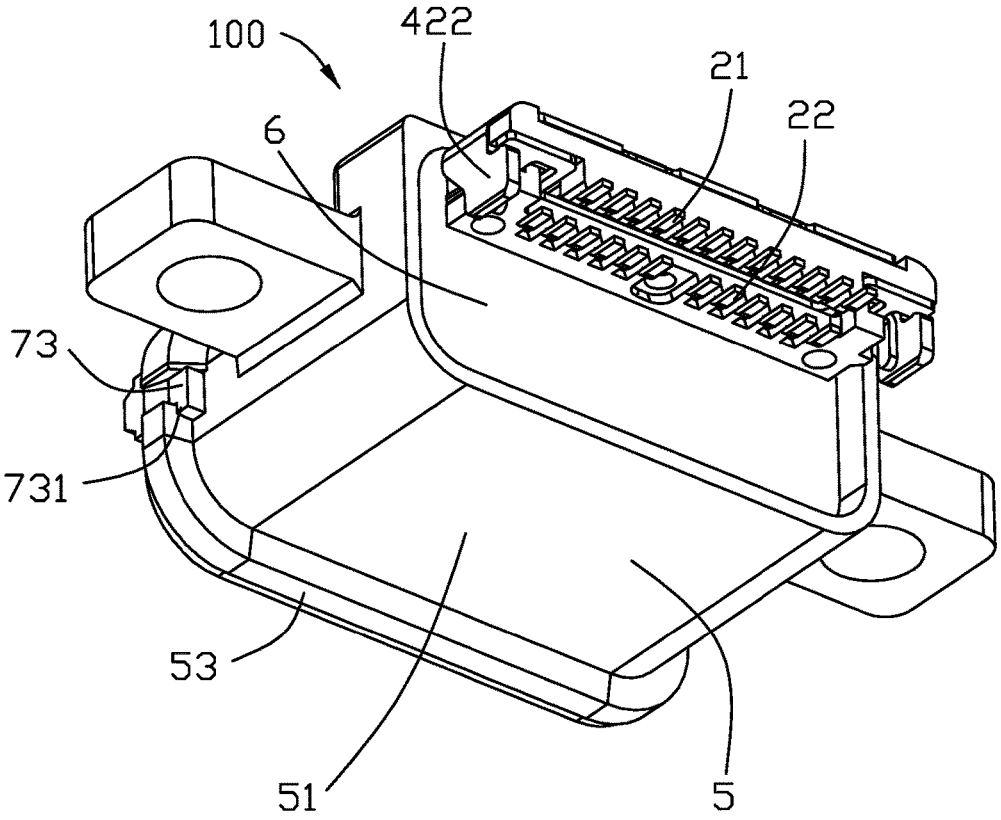
FIG. 2 is a further perspective view of the electrical connector.
Figure 3:
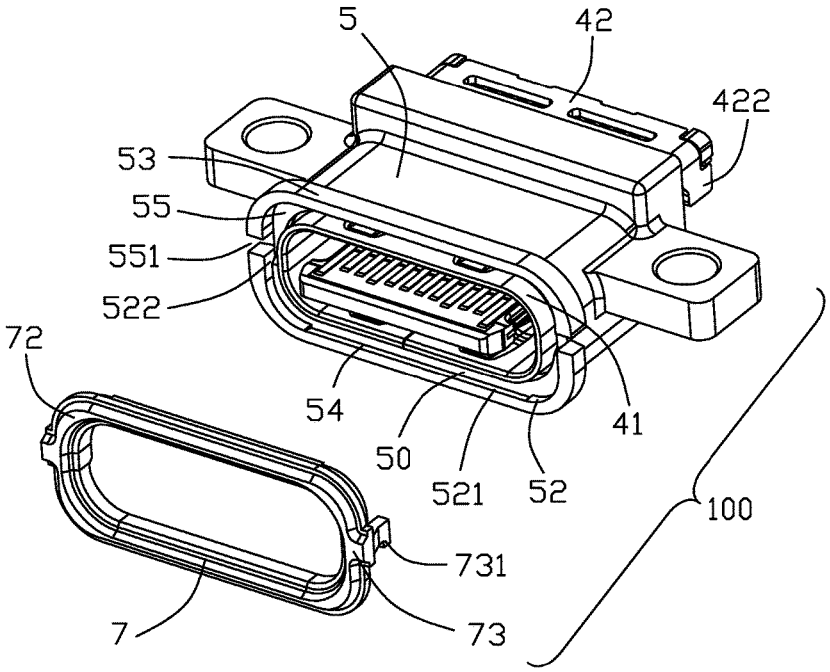
FIG. 3 is a view showing a sealer of the electrical connector not mounted in position yet.
Figure 4:
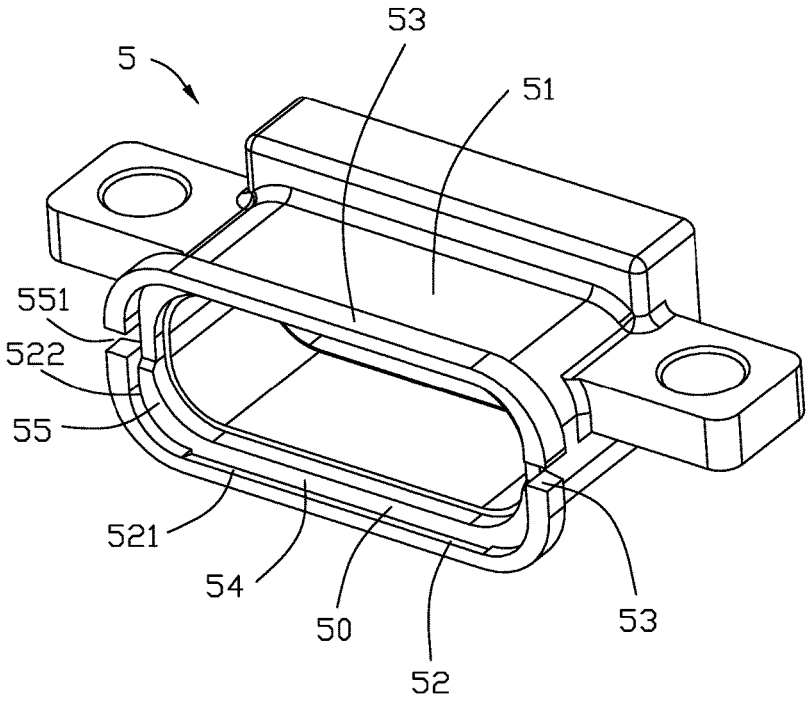
FIG. 4 is a perspective view of an outer cover of the electrical connector.

Referring to FIGS. 1 to 15(A), an electrical connector 100 includes an insulative housing 1, a plurality of contacts 2 affixed to the insulative housing 1, a shielding shell 4 enclosing the insulative housing 1, an outer cover 5 enclosing the shielding shell 4, and a front sealing member or sealer 7 between a front end 41 of the shielding shell 4 and a front protrusion 53 of the outer cover 5. The electrical connector 100 may further include a rear sealer 6.

Referring to FIGS. 8-13, the insulative housing 1 and the contacts 2 constitute a contact module. The contact module may further include a middle shielding plate 3.

Referring again to FIGS. 8-13, the insulative housing 1 includes a base portion 11 and a tongue portion 12 extending forwardly from the base portion 11. The base portion 11 includes a pair of receiving grooves 153 depressed downwardly from an upper surface thereof and a pair of engaging grooves 147 at rear side surfaces thereof and depressed upwardly. The insulative housing 1 further includes a first insulator 13, a second insulator 14, and a third insulator 15. The first insulator 13 includes a first base 131 and a first tongue 132 extending forwardly from the first base 131. The first base 131 includes a holding block 133 and a pair of first locking portions 134 on both sides of a rear end of the holding block 133. The second insulator 14 includes a second base 141 and a second tongue 142 extending forwardly from the second base 141. The second base 141 includes a pair of second locking portions 143 located at a rear end thereof and extending upwardly from an upper surface thereof, a pair of stopper barriers 144, a notch 146 depressed upwardly from a lower surface thereof, and a pair of engaging grooves 147 at rear side surfaces thereof. The pair of stopper barriers 144 surround a receiving space 145. The third insulator 15 includes a third base 151 and a third tongue 152 extending forwardly from the third base 151. The third base 151 includes the pair of receiving grooves 153 located at an upper surface thereof, and the pair of recesses 154 located at a lower surface thereof. The third tongue 152 includes a hollow section 155.

Referring to FIGS. 9-15, the plurality of contacts 2 includes a row of upper contacts 21 and a row of lower contacts 22. Each of the upper contacts 21 and the lower contacts 22 includes a contacting portion 23, a tail 24, and a securing portion 25 connecting the contacting portion 23 and the tail 24. The upper contacts 21 and lower contacts 22 are equal in number. Each contacting portion 23 of the upper contacts 21 is positioned in reverse symmetry with respect to a respective one of the lower contacts 22.

The metallic shielding plate 3 includes a front portion 31, a rear portion 32, and a connecting portion 33. The connecting portion 33 includes a through hole 34 in the middle thereof. The rear portion 32 comprises a pair of fixed pins 321 located at a rear end thereof and extending to both sides, a pair of soldering pins 322 located at a front end of fixed pins 321 and bending downwardly, and a pair of positioning holes 323 located inwardly of the pair of fixed pins 321.

Referring again to FIGS. 1-7, the shielding shell 4 includes a tubular main wall 41 and a shielding sheet 42 extending rearward from a rear end of the main wall 41. The main wall 41 includes a pair of first protrusions 411 located at a rear end thereof, a pair of first bending parts 412 located at a rear end thereof and bent upwardly, and a pair of second protrusions 413 located at a front end of the pair of first bending parts 412, and a pair of second bending parts 4141 located at a rear end thereof and bent inwardly. The shielding sheet 42 includes a main portion 421 and a pair of fixed legs 422 extending downward from both sides of the main portion 441. Each fixed leg 422 has a supporting portion 4221. The tubular main wall 41 forms inside a mating cavity (not labeled) in which the tongue portion 12 extends.

Figure 5:
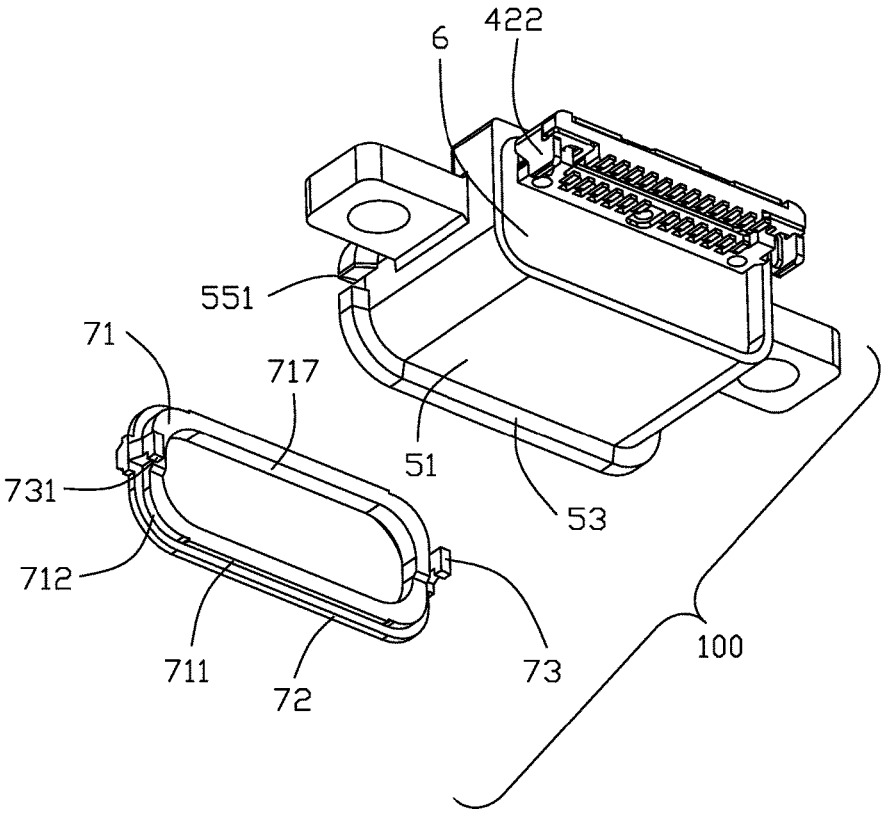
FIG. 5 is a view similar to FIG. 3 but from another perspective.
Figure 6:
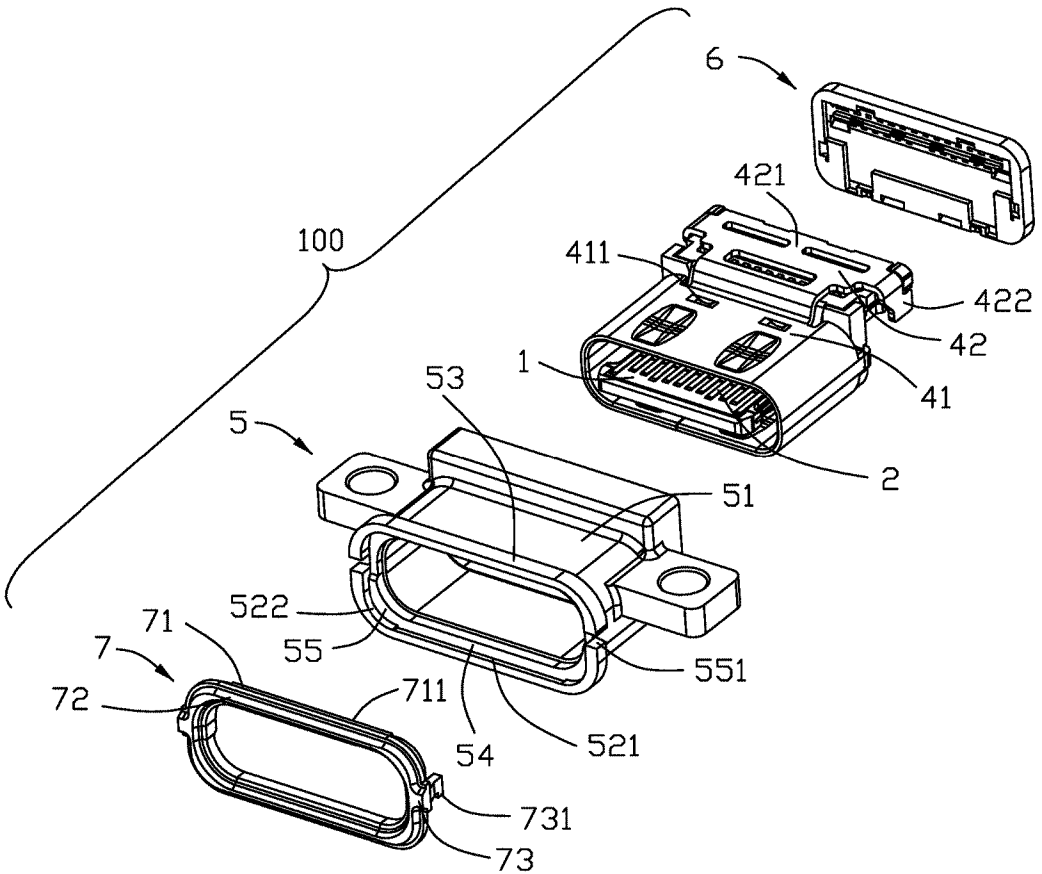
FIG. 6 is an exploded view of the electrical connector.
Figure 7:
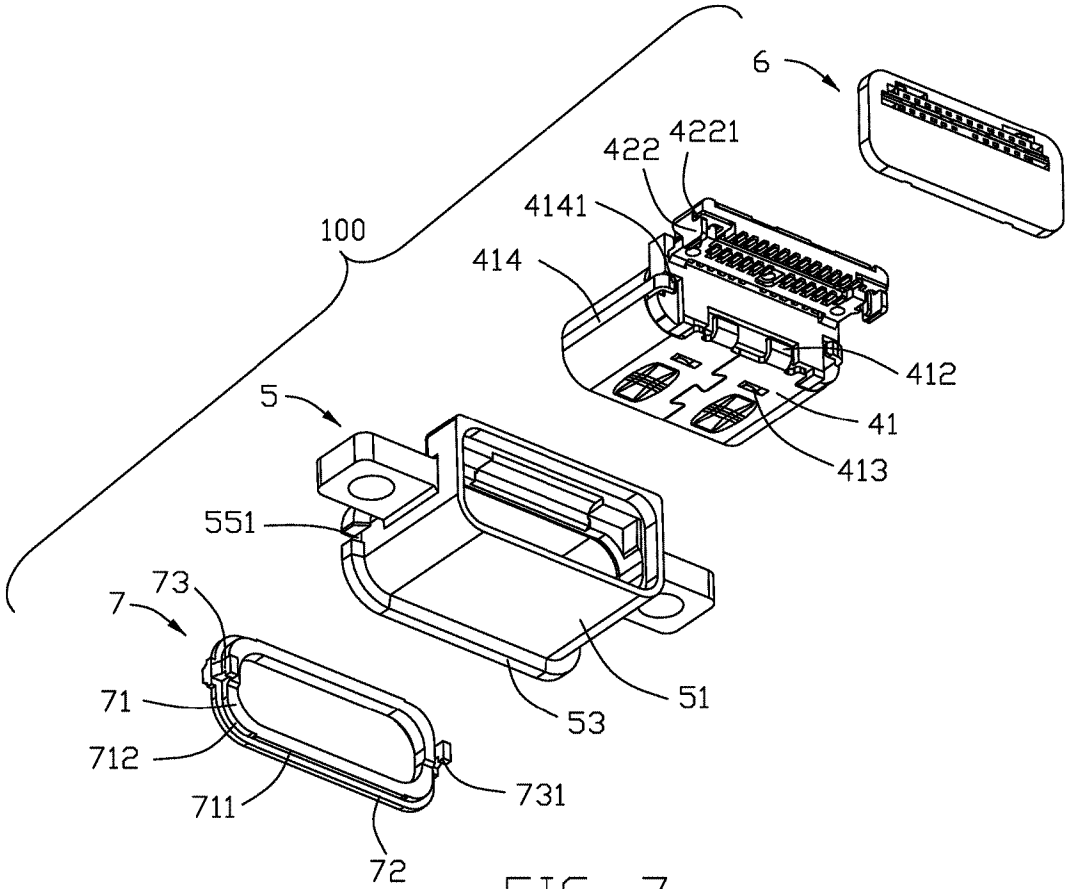
FIG. 7 is a view similar to FIG. 6 but from another perspective.
Figure 8:
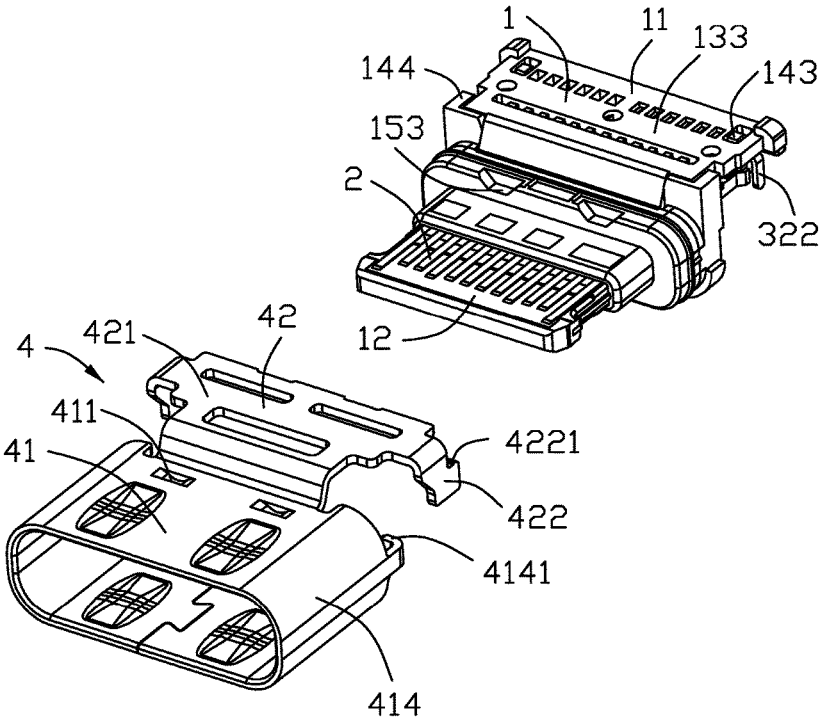
FIG. 8 is an exploded view of a contact module and a shielding shell of the electrical connector.
Figure 9:
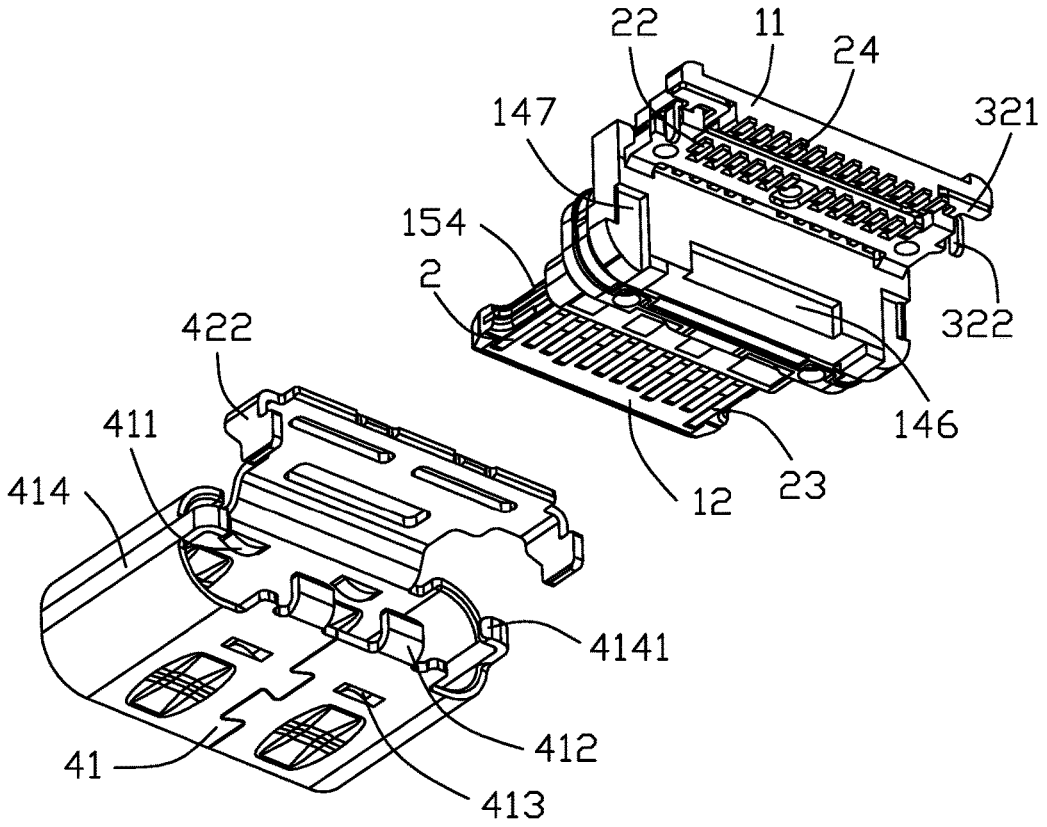
FIG. 9 is a view similar to FIG. 8 but from another perspective.
Figure 10:
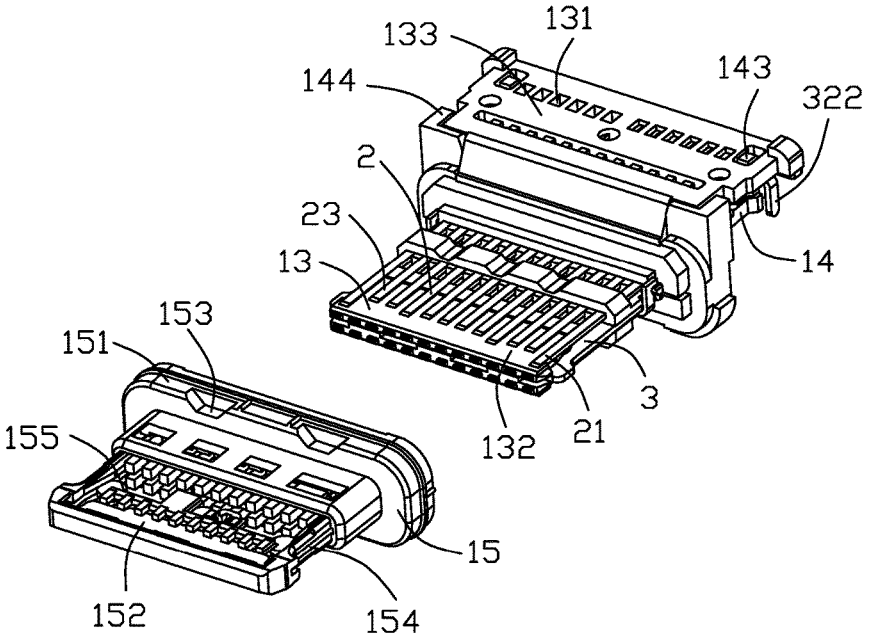
FIG. 10 is an exploded view of the contact module.
Figure 11:
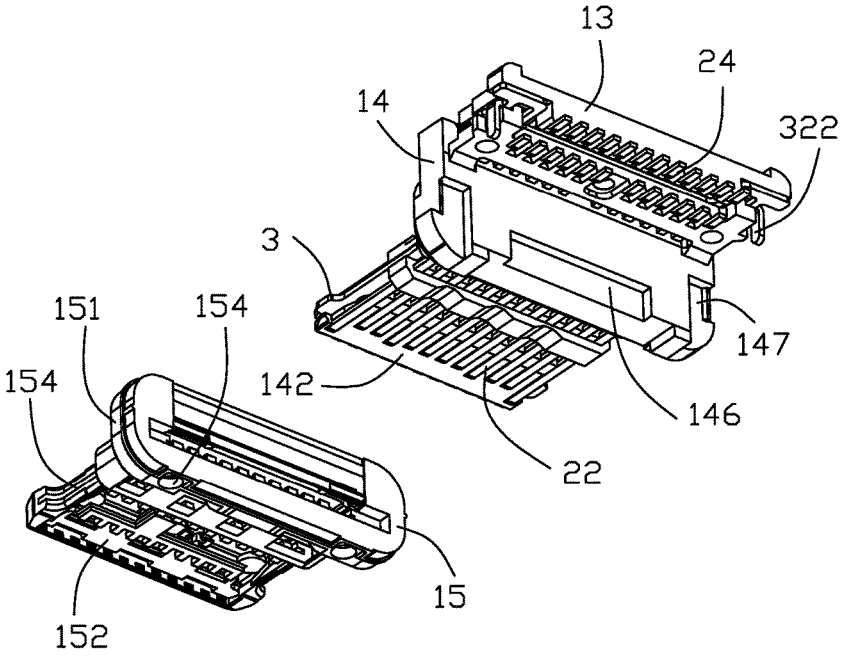
FIG. 11 is a view similar to FIG. 10 but from another perspective.
Figure 12:
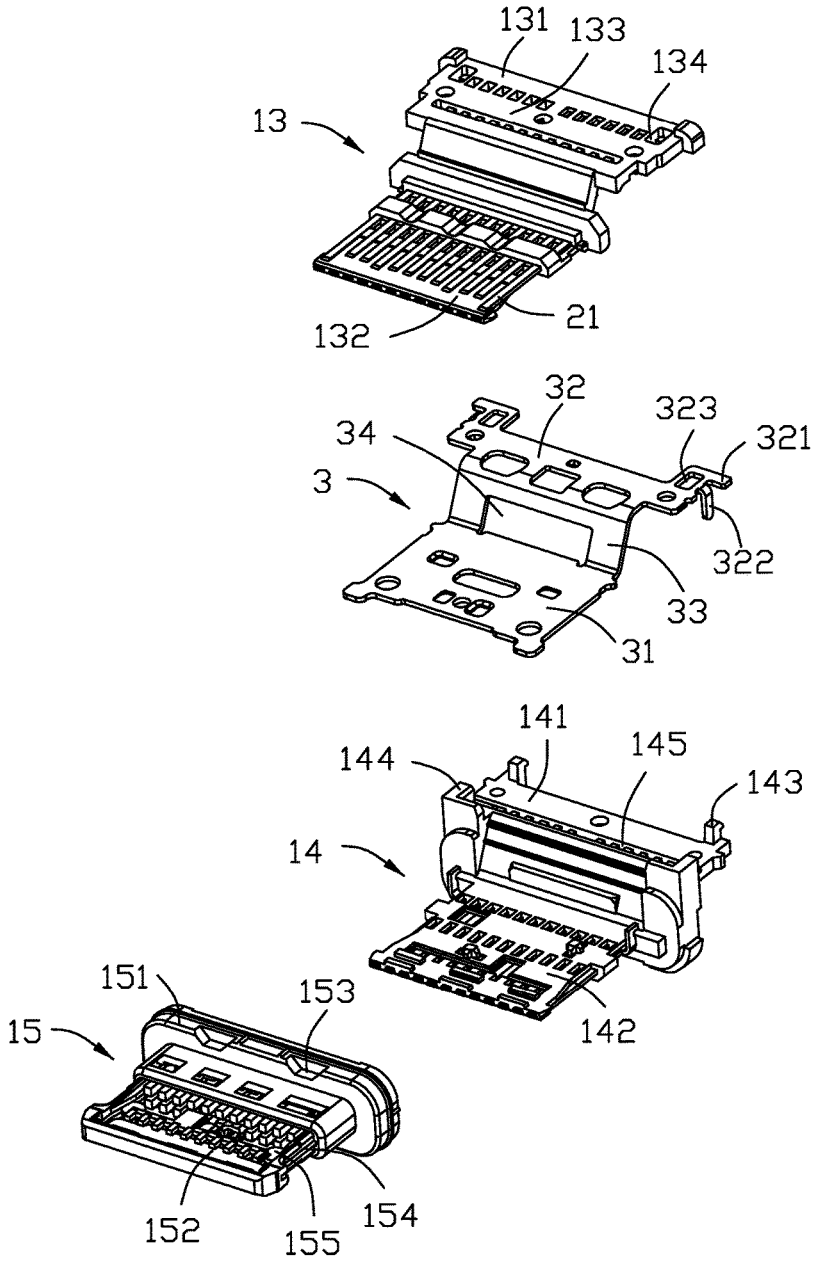
FIG. 12 is a further exploded view of the contact module.
Figure 13:
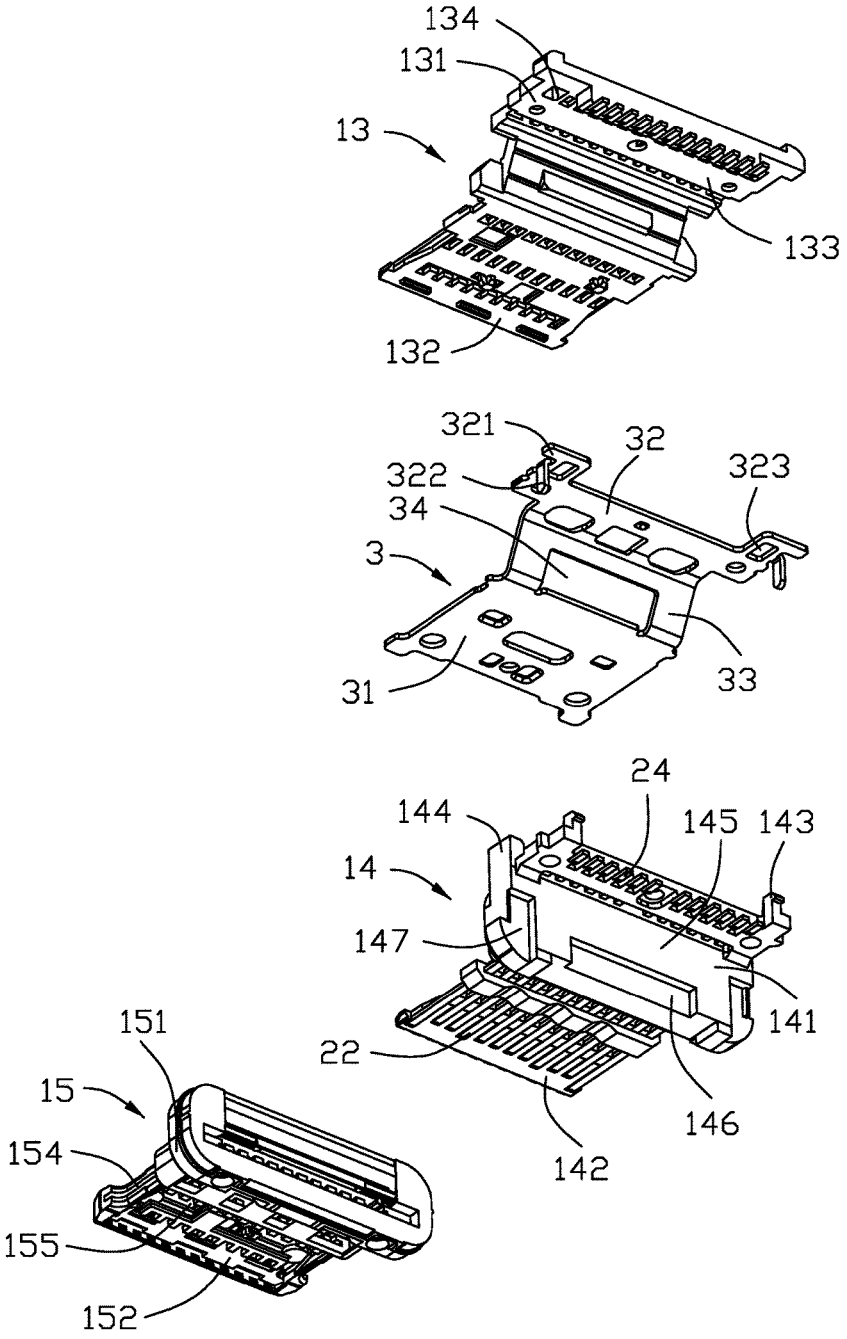
FIG. 13 is a view similar to FIG. 12 but from another perspective.
Figure 14:
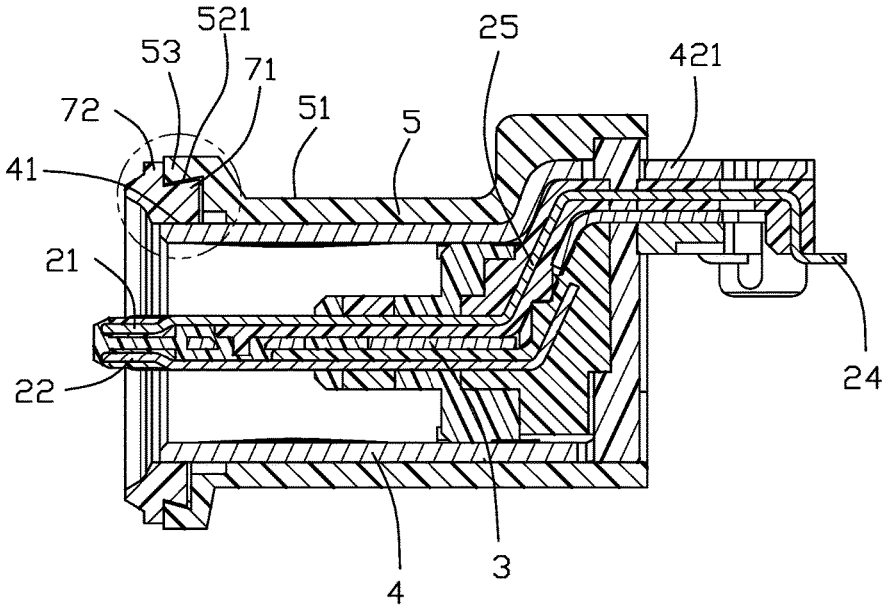
FIG. 14 is a cross-sectional view of the electrical connector taken along line A-A in FIG. 1.
Figure 15:
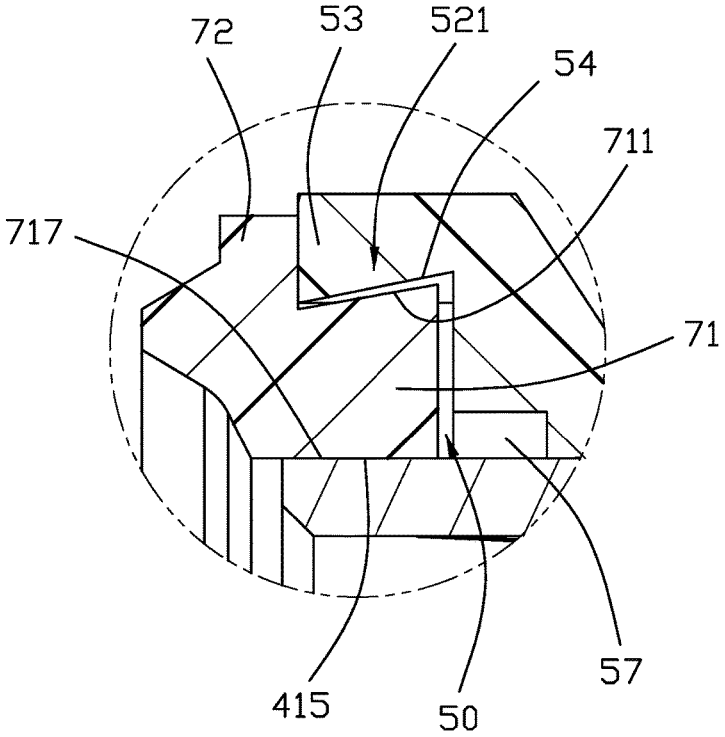
FIG. 15 is an enlarged view of a circled area in FIG. 14.
Figure 15A:
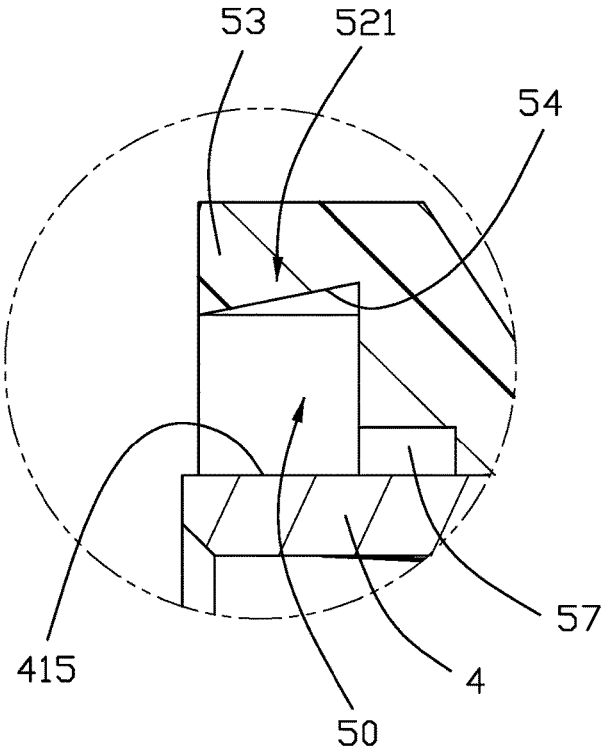

Referring to FIGS. 3-7 and 14-15, an annular groove 50 is defined between the front end 41 of the shielding shell 4 and the front protrusion 53 (or inner wall face 52) of the outer cover 5. The front protrusion 53 of the outer cover 5 has a first inclined face 54 bordering the groove 50. In this embodiment, the first inclined face 54 is planar. Preferably, the front protrusion 53 of the outer cover 5 has a pair of first inclined faces 54 on an upper and low parts 521 thereof, respectively; the other parts 522 of the front protrusion 53 are not inclined, i.e., straight faces 55. The inclined portion may be provided at suitable positions between a closed bottom and a front opening of the annular groove 50. If desired, the shielding shell 4 may also form similar inclined portions. As shown in FIG. 5, besides a straight face 712, the sealer 7 also has a second inclined face 711 opposing the first inclined face 54. A junction between the inclined face 711 and the straight face 712 prevents the sealer 7 from dislodgment due to a rotational displacement. In this embodiment, in the outer cover 5, a groove 57 is formed behind the annular groove 50 for accommodating the possible forward leakage during forming the rear sealer 6 which is made by solidifying the liquid type glue.

Referring again to FIGS. 5-6 and 14-15, the sealer 7 has a rear annular part 71 received within the annular groove 50, a front annular part 72 situated in front of the outer cover front protrusion 53, and a pair of side securing portions 73. The front annular part 72 has a larger outer dimension than the rear annular part 71. The inclined face 711 and the straight face 712 are provided on the rear annular part 71. The securing portion 73 has a hook 731. The pair of securing portions 73 engage a pair of side slots 551 of the outer cover front protrusion 53 so that the front annular part 72 firmly abut a front face of the front protrusion 53 of the outer cover 5.

With the sealer 7 having an inclined face disposed in the annular groove 50 having a corresponding inclined face, the sealer 7 is firmly secured in place without risk of falling off or dislodgment.

It is noted that in this embodiment, the outer cover 5 is insulative and made via an injection molding process. The first inclined face 54 and the second inclined face 711 extend forwardly toward a mid-level of the mating cavity. The engagement between the first inclined face 54 of the outer cover 5 and the second inclined face 711 of the front sealer 7 cooperates with the engagement between the straight horizontal surface 415 of the shell 4 and the straight horizontal surface 717 of the front sealer 7 to have the front sealer 7 tightly sandwiched between the outer cover 5 and the shielding shell 4 in the vertical direction for assuring no withdrawal of the front sealer 7 from the remaining parts of the electrical connector 100. Understandably, the traditional connector lacking the engagement between the inclined surface of the front sealer and the inclined surface of the outer cover in the vertical direction, provides no sufficient retention of the front sealer with regard to the remaining parts of the electrical connector, thus taking the potential risks of dropping the front sealer inadvertently therefrom disadvantageously.

What is claimed is:

1. An electrical connector comprising:

an insulative housing having a base portion and a tongue portion;

a plurality of contacts affixed to the insulative housing and exposed to the tongue portion;

a shielding shell enclosing the insulative housing and having a front end;

an outer cover enclosing the shielding shell and having a front protrusion, the front protrusion having a pair of side slots; and a sealer having a main body and a pair of side securing portions; wherein an annular groove is defined between the front end of the shielding shell and the front protrusion of the outer cover, the front protrusion of the outer cover having a first inclined face bordering the groove; and the sealer main body is disposed in the groove and the side securing portions engage the side slots, the sealer main body having a second inclined face opposing the first inclined face.

2. The electrical connector as claimed in claim 1, wherein the first inclined face of the outer cover front protrusion is planar.

3. The electrical connector as claimed in claim 1, wherein the front protrusion of the outer cover has a pair of first inclined faces on an upper part and a low part thereof, respectively.

4. The electrical connector as claimed in claim 1, wherein the sealer has a rear annular part received within the annular groove and a front annular part abutting the front protrusion of the outer cover.

5. An electrical connector comprising:

an insulative housing;

a plurality of contacts affixed to the insulative housing;

a shielding shell enclosing the insulative housing, forming a mating cavity, and having a front end;

an outer cover enclosing the shielding shell and having a front protrusion;

an annular groove defined between the front end of the shielding shell and the front protrusion of the outer cover, the front protrusion of the outer cover having a first inclined face bordering the groove; and a front sealer having a main body disposed in the groove, the main body of the front sealer forming a second inclined face intimately engaged with the first inclined face; wherein both said first inclined face and the second inclined face extend forwardly toward a mid-level of the mating cavity.

6. The electrical connector as claimed in claim 5, wherein the outer cover forms a groove located behind and communicating with the annular groove in a front-to-back direction.

7. The electrical connector as claimed in claim 5, wherein the first inclined face of the outer cover front protrusion is planar.

8. The electrical connector as claimed in claim 5, wherein the front protrusion of the outer cover has a pair of first inclined faces on an upper part and a low part thereof, respectively.

9. The electrical connector as claimed in claim 5, wherein the front sealer has a rear annular part received within the annular groove and a front annular part abutting the front protrusion of the outer cover.

10. The electrical connector as claimed in claim 5, wherein the main body of the front sealer further forms a straight horizontal surface abutting against another straight horizontal surface of the shielding shell so as to have the main part tightly sandwiched between the front protrusion of the outer cover and the front end of the shielding shell.

11. An electrical connector comprising:

an insulative housing;

a plurality of contacts affixed to the insulative housing;

a shielding shell enclosing the insulative housing, forming a mating cavity, and having a front end;

an outer cover enclosing the shielding shell and having a front protrusion;

an annular groove defined within the front protrusion and having a first inclined face bordering the groove; and a front sealer having a main body disposed in the groove, the main body of the front sealer forming a second inclined face intimately engaged with the first inclined face; wherein both said first inclined face and the second inclined face extend forwardly toward a mid-level of the mating cavity.

12. The electrical connector as claimed in claim 11, wherein the outer cover forms a groove located behind and communicating with the annular groove in a front-to-back direction.

13. The electrical connector as claimed in claim 11, wherein the first inclined face of the outer cover front protrusion is planar.

14. The electrical connector as claimed in claim 11, wherein the front protrusion of the outer cover has a pair of first inclined faces on an upper part and a low part thereof, respectively.

15. The electrical connector as claimed in claim 14, wherein the front sealer has a rear annular part received within the annular groove and a front annular part abutting the front protrusion of the outer cover.

16. The electrical connector as claimed in claim 11, wherein the main body of the front sealer further forms a straight horizontal surface abutting against another straight horizontal surface of the shielding shell.

* * * * *